US006419241B1

(12) United States Patent
Chenevert

(10) Patent No.: US 6,419,241 B1
(45) Date of Patent: Jul. 16, 2002

(54) ICE SKATE RUNNER

(75) Inventor: François Chenevert, Blainville (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/467,527

(22) Filed: Dec. 21, 1999

(30) Foreign Application Priority Data

Dec. 22, 1998 (CA) ..... 2256921
Nov. 19, 1999 (CA) ..... 2290209

(51) Int. Cl.[7] ..... A63C 1/30
(52) U.S. Cl. ..... 280/11.18; 280/11.14; 280/11.17; 280/11.223
(58) Field of Search ..... 280/11.14, 11.17, 280/11.18, 11.223

(56) References Cited

U.S. PATENT DOCUMENTS 4,132,424 A * 1/1979 Olivieri ..... 280/11.3
4,150,499 A * 4/1979 Wang ..... 36/115
5,088,749 A * 2/1992 Olivieri ..... 280/11.18
5,123,664 A * 6/1992 DeMars ..... 280/11.18
5,314,199 A * 5/1994 Olson et al. ..... 280/7.13
5,887,898 A * 3/1999 Petrosino ..... 280/825

FOREIGN PATENT DOCUMENTS

| | | |
|---|---|---|
| CA | 1113129 | 11/1981 |
| CA | 2210386 | 1/1999 |
| CA | 2243095 | 1/1999 |

* cited by examiner

*Primary Examiner*—Kenneth R. Rice
*Assistant Examiner*—Christopher Buchanan
(74) *Attorney, Agent, or Firm*—Ratner & Prestia

(57) ABSTRACT

An ice skate assembly with a provision for the replacement of ice skate runners. The ice skate assembly includes a molded runner holder having a pair of side walls, the side walls extending downwards and forming a groove therebetween where a runner is received, a recess and a bore suitable for receiving a fastener. The ice skate runner is fastened to the runner holder by a runner projection suitable to be engaged with the recess on the molded runner holder and a fastener passing transversely through the runner and through the bore of the molded runner holder. The fastener is adapted to exert a force on the ice skate runner such that the hooked portion is engaged on the recess and the runner is secured to the runner holder. The force exerted on the ice skate runner comprises a generally longitudinal component, a generally upward component and a generally transversal component.

16 Claims, 4 Drawing Sheets

ICE SKATE RUNNER

FIELD OF THE INVENTION

This invention relates to ice skates, and more particularly to an ice skate assembly. The invention is directed to an improved runner holder and replaceable ice skate runner and tightening mechanism therefore.

BACKGROUND

It is well known to form ice skate assemblies with a provision for the replacement of the runner, also known as the runner.

Commonly, such assemblies comprise a runner holder commonly moulded from a thermoplastic material, having a groove there along within which the runner is received. In accordance with one proposal, the runner is locked to the runner holder by two or more threaded fastener means that pass transversely through the runner and runner holder at longitudinally spaced apart intervals. This arrangement is advantageous in that it permits the rapid replacement of the runner by the use of two very simple tools.

In accordance with the second proposal, the runner is locked to the runner holder by two or more threaded fastener means which pass upwardly through the runner holder. This second means of locking the runner to the runner holder is the choice of many persons, as it permits the runner to be strongly bias into contact with the runner holder. A deficiency in the above-described arrangement is that the replacement of the runner usually necessitates demounting the assembly from the footwear such as to gain access to the threaded fastening means for the release thereof.

Another deficiency in the above-described arrangements is the requirement of using two or more fastener means. The use of two or more fastener means renders the change of a runner cumbersome as well as requiring a longer time to replace a runner.

Consequently there is a need in the industry to provide a runner that can easily be locked to and removed from the runner holder.

SUMMARY

In accordance with a broad aspect, the invention provides an ice skate runner and runner holder assembly adapted to be attached to an ice skate boot. The runner includes a hooked portion and a fastener aperture. The runner holder includes a bore hole and a recess adapted to engage the hooked portion. In operation, the skate runner and the runner holder are attachable and detachable by an attachment means adapted to apply a force to the skate runner having a longitudinal component and an upward component.

Preferably, the bore hole is a sole bore hole, the attachment means is a sole attachment means and the force further comprises a transversal component.

Advantageously, the invention allows attaching and detaching the runner and runner holder with a single attachment means.

In accordance with another aspect, the invention provides an ice skate assembly comprising a runner holder including a member adapted to engage a runner projection and a bore suitable for receiving a fastener. The ice skate assembly further provides an ice skate runner comprising a runner projection at one end configured to engage the member of the runner holder and a fastener aperture remote from the runner projection and adapted to align with the bore when in operation. A fastener constructed to pass through the fastener aperture of the ice skate runner and the bore of the runner holder is provided. The fastener is adapted to exert a force on the ice skate runner such that the runner projection is engaged on the member of the runner holder.

In accordance with another aspect, the invention provides an ice skate runner adapted to be fastened to a runner holder having a recess adapted to engage a runner projection and a bore suitable for receiving a fastener. The ice skate runner comprises a runner projection at one end configured to engage the recess of the runner holder and a fastener aperture remote from the runner projection and adapted to align with the bore when in operation. The ice skate runner is adapted to be fastened to the runner holder by a fastener adapted to exert a force on the ice skate runner such that the runner projection is securely engaged on the recess of the runner holder.

Preferably, the ice skate runner is adapted to be fastened to the runner holder by a single fastener.

In accordance with another aspect, the invention provides an ice skate assembly comprising a moulded runner holder including a pair of side walls extending downwards and forming a groove therebetween. The runner holder further comprises a pivot member defining a pivot point and a bore suitable for receiving a fastener. An ice skate runner is also provided comprising a lower ice contacting edge, an upper edge generally opposed to the lower edge, the upper edge being adapted to be received by the groove of the moulded runner holder. The skate runner also comprises a runner projection at one end configured to engage the pivot member of the moulded runner holder and a fastener aperture remote from the hooked portion and adapted to align with the bore when in operation. The ice skate assembly further comprises a fastener suitable to pass transversely through the aperture of the ice skate runner and the bore of the moulded runner holder. The fastener is adapted to exert a force on the ice skate runner such that the hooked portion is engaged on the pivot member of the moulded runner holder.

Preferably, the force exerted on the ice skate runner comprises a generally longitudinal component and a generally upward component.

Preferably, the force exerted on the ice skate runner further comprises a transversal component.

Other aspects and features of the present invention will become apparent to those ordinary skilled in the art upon review of the following description of specific embodiments of the invention in conjunction with the accompanying figure.

DETAILED DESCRIPTION

Figure 1:
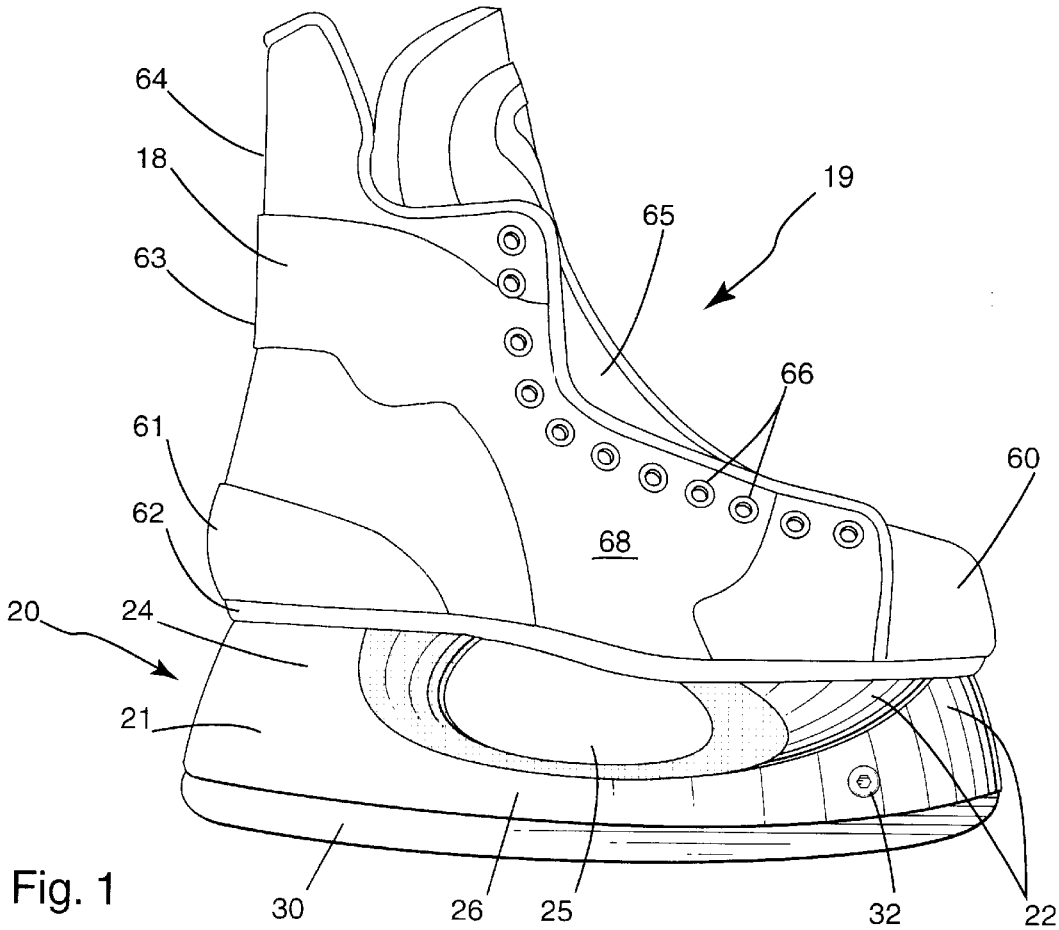
FIG. 1 is a side elevation view of a skate comprising an ice skate runner assembly according to the spirit of the invention mounted to a typical skate boot.

FIG. 1 illustrates an ice skate 19 having a typical skate boot 18 to which is secured an ice skate runner assembly in accordance with a specific example of the invention. Skate boot 18 traditionally features a toe portion 60 at the front of boot 18 to enclose the skater's toes, a heel portion 61 at the rear of boot 18, to support the heel of the skater, side panels 68 on each side of boot 18 to laterally support the foot and an outsole 62 extending from the heel portion 61 to the toe portion 60 and affixed, usually with glue or fasteners, to the bottom of boot 18. The outsole 62 is usually made of a rigid plastic and serves as an anchoring platform for the runner holder 20.

The upper portion of boot 18 comprises an ankle portion 63, enclosing and supporting the ankle of the skater, and a tendon guard 64 extending upwardly from ankle portion 63 to add support to the ankle and protection to the Achilles tendon of the skater. A tongue 65 is attached to the inner side of toe portion 60 and covers the entire frontal area of the foot, the frontal area of the ankle and lower front portion of the leg. An opening is defined between each side panel 68 and tongue 65 for insertion and removal of the foot. Laces are traditionally attached to lacing apertures 66, which extend along the edge of each side panel 68 and enable the wearer to firmly enclose his foot in boot 18.

The ice skate assembly comprises a runner holder 20, an ice skate runner 30 and a fastener 32 adapted to secure the ices skate runner 30 to the runner holder 20.

Figure 2A:
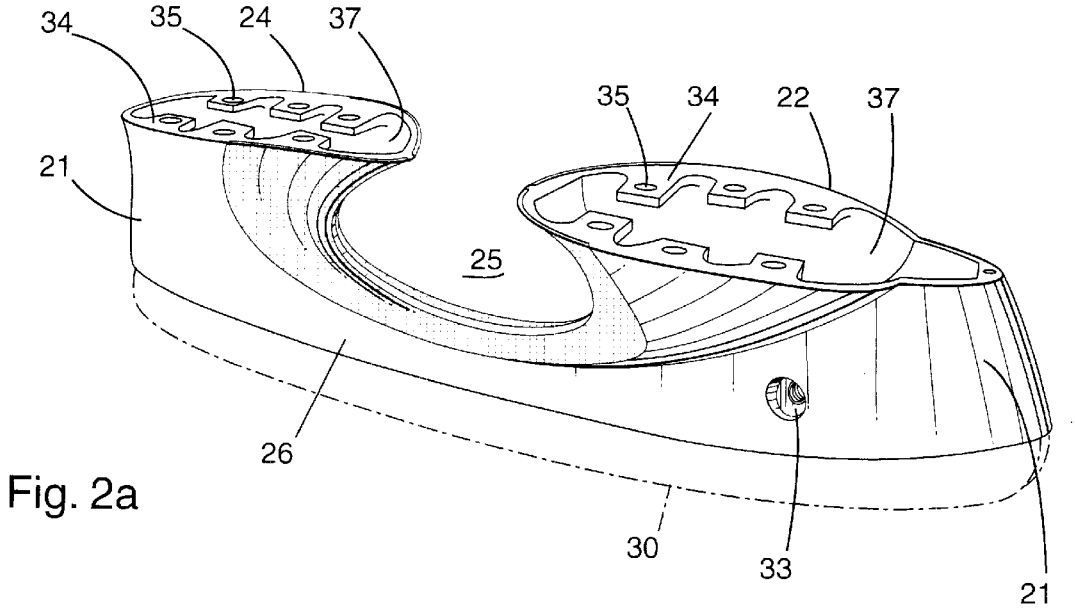
FIG. 2*a* is a perspective view of a runner holder according to a specific example of the invention prior to installation on a skate boot.

As seen in FIG. 2*a,* the runner holder 20 is formed of an elongated plastic moulded frame 21 having a front pedestal 22 adapted to be secured underneath toe portion 60 of skate boot 18, a rear pedestal 24 adapted to be secured underneath heel portion 61 of skate boot 18 and a bridge portion 26 connecting front and rear pedestals 22 and 24 of the runner holder 20. Bridge portion 26 thereby defines an opening 25 in the central area of runner holder 20. Runner holder 20 is rigidly attached to skate boot 18 by fastening front and rear pedestals 22 and 24 to the outsole 62 of skate boot 18 with suitable fasteners. The elongated plastic moulded frame 21 defines a pair of side walls extending downwards and forming a groove 28 therebetween, the groove being adapted to receive the ice skate runner 30.

In a specific example of the invention, the elongated frame 21 is made up of two longitudinal segments that are glued, welded, fused or otherwise suitably coupled together with a fastener along the central axis of frame 21. However, the elongated frame 21 may be made up of a single segment without detracting from the spirit of the invention.

FIG. 2*a* illustrates runner holder 20 prior to attachment to skate boot 18. Front and rear pedestals 22 and 24 are of hollow construction for weight reduction and moulding requirements. A plurality of anchoring projections 34 extend from walls 37 of front and rear pedestals 22 and 24. Each anchoring projection 34 features an aperture 35 provided to fasten runner holder 20 to outsole 62 of skate boot 18 with suitable fasteners. The elongated frame 21 is provided with a bore 33 suitable for receiving fastener 32, which locks the ice skate runner 30 to frame 21. In a specific example, the elongated frame 21 comprise a sole bore 33.

Figure 2B:
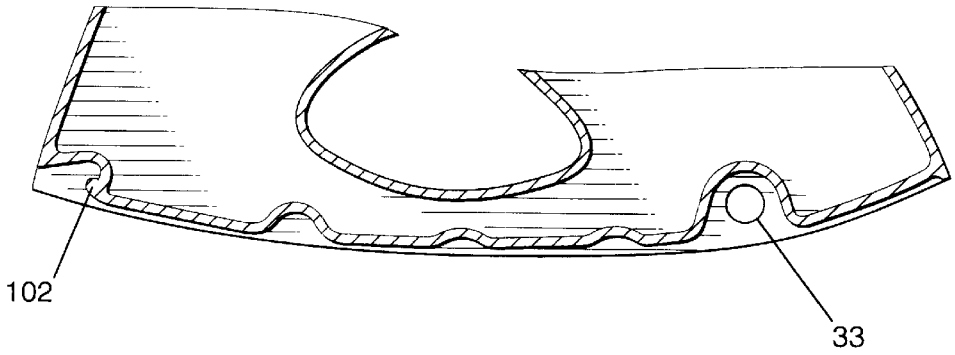
FIG. 2*b* is a sectional view of the runner holder of FIG. 2*a* according to a specific example of the invention.
Figure 4:
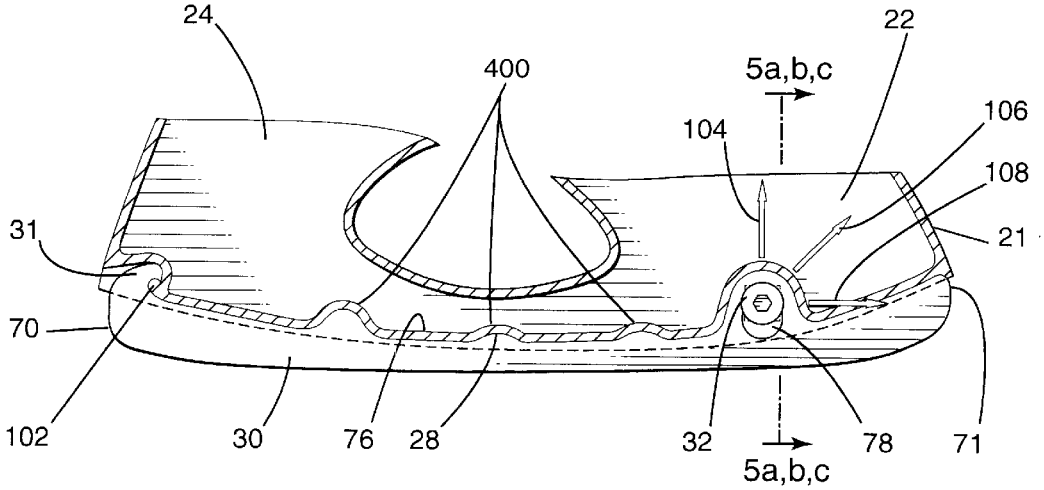
FIG. 4 is a sectional view of an ice skate runner assembly according to a specific example of the invention.

FIG. 2*b* illustrates a sectional view of the elongated frame 21. The elongated frame 21 is further provided with a recess 102 adapted to engage a runner projection. In a specific example, the recess 102 is a pivot member as shown in FIG. 4 securely mounted on the wall of the elongated frame 21. The pivot member may be an integral part of the elongated frame 21 or a separate component mounted on the elongated frame 21.

Figure 3:
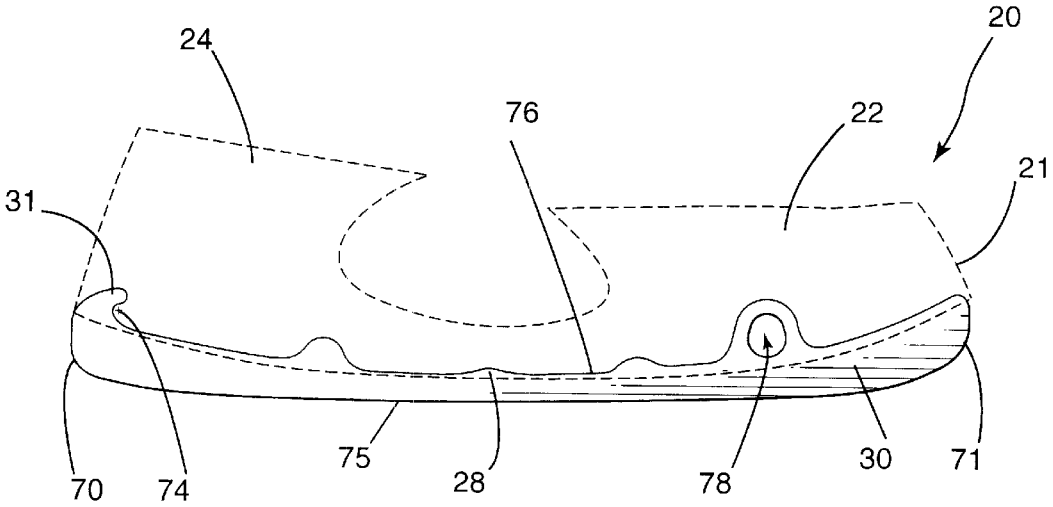
FIG. 3 is a side elevation view of an ice skate runner in accordance with a specific example of the invention.

FIG. 3 shows a side elevation view of an ice skate runner 30. In a specific example of the invention, the ice skate runner 30 is a narrow steel strip extending along the length of runner holder 20. The ice skate runner comprises a lower ice contacting edge 75, an upper edge 76 generally opposed to the lower edge 75. The upper edge is adapted to be received by the groove 28 of the moulded runner holder 20. The ice skate runner has a projection 31 at one end configured to engage the recess 102 of the runner holder 20. In a specific example, the projection 31 is a hooked portion 31 suitable to engage the pivot member 102 of the moulded runner holder 20. The ice skate runner has a fastener aperture 78 remote from said runner projection 31 adapted to generally align with the bore 33 of the runner holder 20. The fastener aperture 78 is generally elliptical in configuration and is suitable for receiving the fastener 32 there through.

As shown in FIG. 4, when the ice skate runner 30 is positioned with the upper edge 76 in the groove 28 of the runner holder 20 and the runner projection 31 is engaged with the recess 102 of the moulded runner holder 20, the fastener aperture 78 is essentially aligned with the bore 33 of the runner holder 20.

The ice skate runner is sharpened on its lower ice contacting edge 75 and provided with protrusions 400 on its upper side 76. In a specific example of the invention, the ice skate runner has a curved profile, which is accentuated near its extremities 70 and 71. The ice skate runner 30 is inserted into the longitudinal groove 28 of the runner holder and secured to frame 21 with runner protection 31, which engages onto recess 102 defining pivot point 74 and front fastener 32 (shown in FIG. 1), which locks fastener aperture 78 to frame 21.

As a variant, the upper edge 76 of the ice skate runner 30 includes a plurality of longitudinally spaced apart protrusions 400, the protrusions 400 being adapted to stabilise the ice skate runner in the groove 28 of the runner holder 20. In a specific example, the walls of the runner holder 20 are provided with a plurality of cavities adapted to engage with the protrusions of the ice skate runner.

In a specific example, fastener 100 passes transversely through the fastener aperture 78 of the ice skate runner 30 and the bore 33 of the moulded runner holder 20. Fastener 100 is adapted to exert a force on the ice skate runner such that the runner projection 31 is engaged on the recess 102 of the runner holder 20.

Advantageously, fastener 32 allows the ice skate runner 30 to be secured to the runner holder by a sole attachment means.

Figures 5A, 5B, 5C:
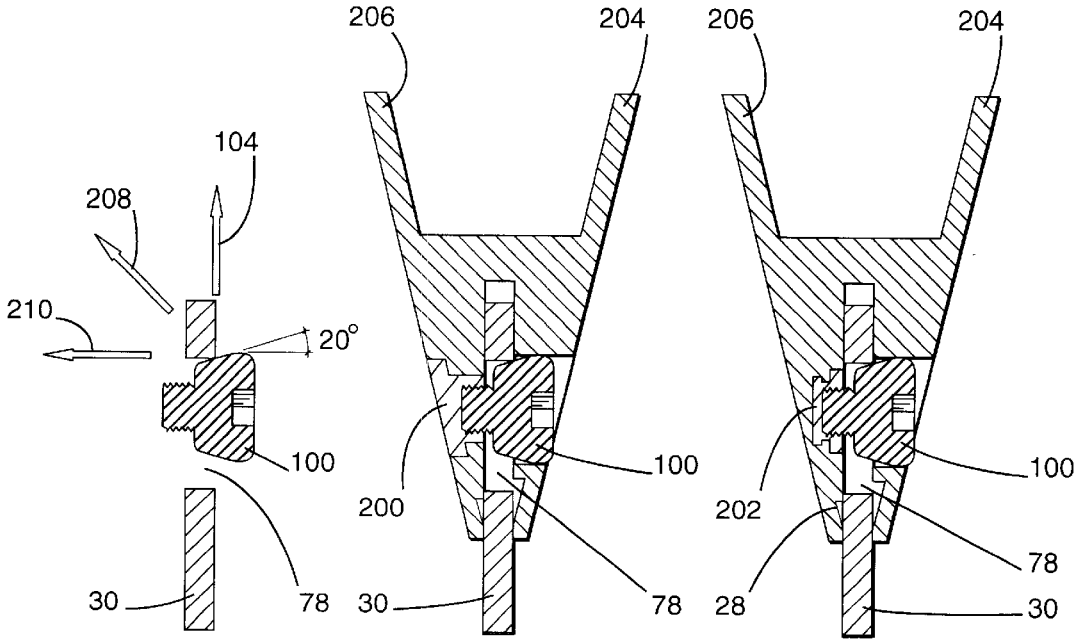
FIGS. 5*a,* 5*b,* 5*c* are sectional views of the runner holder of FIG. 4 taken at line 5*a, b, c;*

FIG. 5*b* and 5*c* show transversal sectional view of the ice skate runner and runner holder assembly. In a first embodiment shown in FIG. 5*b,* the fastener 32 includes a threaded nut 200 and a threaded bolt 100. The threaded nut 200 is imbedded in a wall 206 of the runner holder 20 and the bolt 100 is adapted in operation to pass through the fastener aperture 78 and the bore 33 in the runner holder 20 and be fixedly secured in the nut 200. In this configuration, the nut 200 may be inserted subsequently to the moulding of the runner holder. A variant, the nut 200 is separate from the runner holder and is secured to the runner holder by the action of the bolt 100.

In a second embodiment shown in figure 5*c,* the threaded nut 202 is imbedded in a wall 206 of the runner holder 20 and the bolt 100 is adapted to pass through the fastener aperture 78 and the bore 33 in the runner holder 20 and be fixedly secured in the nut 202.

Figure 6A:
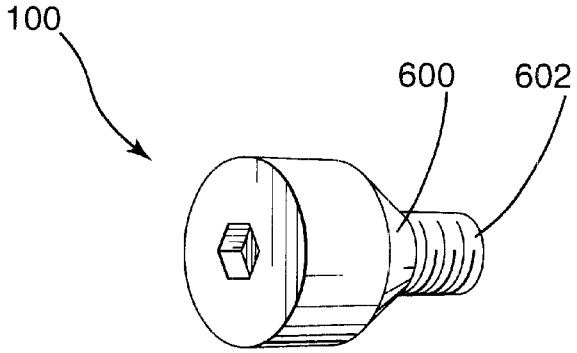
FIGS. 6*a,* 6*b,* 6*c* and 6*d* are view of variants of fasteners suitable for use in the ice skate runner assembly of FIG. 4.
Figure 6B:
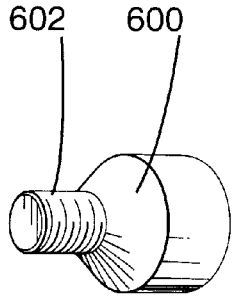
Figure 6C:
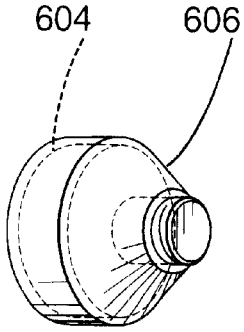
Figure 6D:
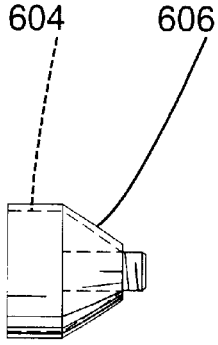

The bolt 100 includes a tapered head. FIGS. 6*a* and 6*b* shows specific examples of a conical bolt suitable for use as a fastener. The conical bolt 100 includes a tapered head portion 600 and a threaded lower portion 602. FIGS. 6*c* and 6*d* show an alternative embodiment of the fastener comprises a conventional bolt 604 and a sleeve 606. In operation, the sleeve 606 is slipped around the bolt 604 such as to provide a tapered head.

As shown in FIG. 4 and 5*a,* the force exerted on the ice skate runner comprises a generally longitudinal component 108, a generally transversal component 210 and a generally upward component 104. For the purpose of illustration, the force exerted on the ice skate runner is drawn in FIGS. 4 and 5*a* as forces 106 and 208 in the planes defined by components 104 108 and 210 104 respectively. The longitudinal component 108 allows the projection 31 to be securely engaged to recess 102 and puts the ice skate runner under tension. The upward component 104 is operative to secure the upper edge 76 of the ice skate runner 30 within the groove 28 of the runner holder 20. The transverse component 210 is operative to secure the ice skate runner 30 to the wall of the runner holder 20.

Advantageously, when the fastener with a tapered head passes through the fastener aperture 78 and the bore 33 and is secured in the nut, the tapered head, as shown in FIGS. 4 and 5*a,* produces forces 106 and 208 on the runner 30 thereby securing the runner 30 to the runner holder 20 under tension by securely engaging the runner projection 31 and the recess 102.

Advantageously, the use of a generally elliptical fastener aperture 78 in conjunction with a tapered head allows the tapered head to produce an upward force on the runner 30 thereby securing the runner 30 to the runner holder 20 under tension.

The runner holder comprises an inner wall 204 and an outer wall 206 defining an inner side and an outer side of the ice skate runner 30. Preferably, but not essentially, the fastener is positioned such that the head of the bolt is on the inner wall 204 the runner holder when in operation. Advantageously, positioning the fastener on the inner wall 204 of the runner holder allows a person wearing skates having the runner holder assembly to conveniently replace the runner 30 without removing the ice skates.

Although the present invention has been described in considerable detail with reference to certain preferred embodiments thereof, variations and refinements are possible without departing from the spirit of the invention. Therefore, the scope of the invention should be limited only by the appended claims and their equivalents.

What is claimed is:

1. An ice skate blade assembly for attachment to a skate boot, said ice skate blade assembly comprising:

(a) an ice skate blade comprising an ice contacting edge, a hooked portion, and a fastener aperture;

(b) a blade holder having front and rear pedestals with respective top portions for attachment to the skate boot and a bridge portion connecting said front and rear pedestals, said blade holder further having a bore hole and a recess for receiving said hooked portion;

(c) an attachment means for attaching and detaching said blade holder and said ice skate blade, said attachment means being adapted to apply a force to said ice skate blade in a longitudinal direction and in an upward direction.

2. The ice skate blade assembly as defined in claim 1 wherein said attachment means is further adapted to apply a force to said ice skate blade in a transverse direction.

3. The ice skate blade assembly as defined in claim 2 wherein said bore hole is a sole bore hole and said attachment means is a sole attachment means.

4. The ice skate blade assembly as defined in claim 3 wherein said attachment means comprises a threaded nut and a threaded bolt; said nut being imbedded in said blade holder and said bolt being adapted in operation to pass through said fastener aperture and said bore hole in said blade holder and be fixedly secured in said nut.

5. The ice skate blade assembly as defined in claim 4 wherein said bolt is tapered.

6. The ice skate blade assembly as defined in claim 5 wherein said fastener aperture is generally elliptical.

7. The ice skate blade assembly as defined in claim 6 wherein, in operation, when said tapered bolt passes through said generally elliptical fastener aperture and said bore hole and is secured in said nut, said tapered bolt produces an upward force on said ice skate blade thereby securing said ice skate blade to said blade holder under tension.

8. An ice skate blade assembly for attachment to a skate boot, said ice skate blade assembly comprising:

(a) a blade holder having front and rear pedestals with respective top portions for attachment to the skate boot and a bridge portion connecting said front and rear pedestals, said blade holder further having a bottom portion with a recess and a fastener bore remote from said recess;

(b) an ice skate blade having a proximal end portion, a distal end portion remote from said proximal end portion, and an ice-contacting edge extending from said proximal end portion to said distal end portion, said proximal end portion having a projection adapted to engage within said recess, said distal end portion having a fastener aperture generally aligned with said fastener bore;

(c) a fastener extending through said fastener bore and said fastener aperture, said fastener being adapted to exert a force on said ice skate blade such that said projection is engaged within said recess.

9. The ice skate blade assembly as defined in claim 8 wherein the force exerted on said ice skate blade has a longitudinal component and an upward component.

10. The ice skate blade assembly as defined in claim 9 wherein said fastener comprises a threaded nut and a threaded bolt, said threaded nut being embedded in said ice skate blade.

11. The ice skate blade assembly as defined in claim 10 wherein said bolt is tapered.

12. The ice skate blade assembly as defined in claim 11 wherein said fastener comprises a conical bolt.

13. The ice skate blade assembly as defined in claim 9 wherein said projection comprises a hook.

14. The ice skate blade assembly as defined in claim 13 wherein said ice skate blade comprises respective inner and outer sides, said fastener being position on said inner side.

15. The ice skate blade assembly as defined in claim 9 wherein said bottom portion further comprises a longitudinal groove, said ice skate blade comprises an upper edge opposed to said ice contacting edge, said upper edge comprising a plurality of longitudinally spaced apart protrusions for stabilizing said ice skate blade in said groove.

16. An ice skate blade assembly for attachment to a skate boot, said ice skate blade assembly comprising:

(a) a blade holder having:

(i) front and rear pedestals with respective top portions for attachment to the skate boot, (ii) a bridge portion connecting said front and rear pedestals, and (iii) a bottom portion defining a longitudinal groove and having a recess and a fastener bore remote from said recess;

(b) an ice skate blade having:

(i) a proximal end portion with a projection adapted to engage within said recess, (ii) a distal end portion remote from said proximal end portion, said distal end portion having a fastener aperture generally aligned with said fastener bore, (iii) an ice-contacting edge extending from said proximal end portion to said distal end portion, and (iv) an upper edge opposed to said ice-contacting edge, said upper edge having a plurality of longitudinally spaced apart protrusions for stabilizing said ice skate blade in said groove; and (c) a fastener extending through said fastener bore and said fastener aperture, said fastener being adapted to exert a force on said ice skate blade such that said projection is engaged within said recess.

* * * * *